US010961102B2

(12) United States Patent
Stubbings

(10) Patent No.: US 10,961,102 B2
(45) Date of Patent: Mar. 30, 2021

(54) METHOD OF FILLING A FLUID HOUSING WITH FLUID

(71) Applicant: Schaeffler Technologies AG & Co. KG, Herzogenaurach (DE)

(72) Inventor: Kevin Stubbings, Troy, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/299,878

(22) Filed: Mar. 12, 2019

(65) Prior Publication Data

US 2020/0290857 A1 Sep. 17, 2020

(51) Int. Cl.
*B67C 3/26* (2006.01)
*B67C 3/24* (2006.01)
*B67C 3/16* (2006.01)

(52) U.S. Cl.
CPC ..... *B67C 3/2634* (2013.01); *B67C 3/16* (2013.01); *B67C 3/24* (2013.01)

(58) Field of Classification Search
CPC ..... B67C 3/2634; B67C 3/16; B67C 3/24
USPC ..... 141/59, 61, 8
See application file for complete search history.

(56) References Cited

U.S. PATENT DOCUMENTS 3,282,306 A * 11/1966 Greenhut ..... B65B 3/14 141/7
4,840,151 A * 6/1989 Sakata ..... F01L 1/2405 123/90.43
5,112,142 A * 5/1992 Titcomb ..... F16C 17/105 277/361
9,650,921 B2 5/2017 Nielsen et al.
10,066,517 B2 9/2018 Kretschmer et al.
2007/0227615 A1* 10/2007 Lim ..... F16C 33/10 141/59
2015/0369087 A1* 12/2015 Nielsen ..... F01L 1/24 141/1

FOREIGN PATENT DOCUMENTS

DE 102006045017 A1 3/2008
DE 102015221038 A1 8/2016
EP 3161280 B1 5/2018

OTHER PUBLICATIONS

"Removing Air From Oils, Epoxies, Hydraulic Fluids, Adhesives, Waxes and Other Liquids", found at http://blog.sonomechanics.com/blog/ultrasonic-degassing-of-viscous-liquids (Year: 2016).*
Sivlaninis et al, "Ultrasonic generator-transducer combined performance enhancement" Kansas University of Technology JAE vol. 10 No. 1 (Year: 2008).*

* cited by examiner

*Primary Examiner* — Timothy P. Kelly
*Assistant Examiner* — Christopher M Afful
(74) *Attorney, Agent, or Firm* — Volpe Koenig

(57) ABSTRACT

A method of filling at least one fluid housing with fluid is disclosed. The method includes: (a) arranging at least one fluid housing within a sealable vessel containing a fluid and attached to a vacuum; and (b) activating the vacuum such that air is withdrawn from the sealable vessel and the fluid is drawn into the at least one fluid housing.

18 Claims, 9 Drawing Sheets

METHOD OF FILLING A FLUID HOUSING WITH FLUID

FIELD OF INVENTION

The present invention relates to a filling method for a fluid housing.

BACKGROUND

Fluid housings, such as lash adjusters, are used in a wide range of applications. These housing typically have at least one internal chamber that contains fluid in order to effectuate some actuating function.

Known lash adjuster assemblies are disclosed in U.S. Pat. No. 10,066,517; DE 200610045017; EP 20150717410; and DE 201510221038, which are each incorporated by reference as if fully set forth herein.

During shipping or pre-installation handling, fluid housings typically inherently lose some fluid or the fluid contained therein develops air bubbles. It is undesirable for fluid housings, particularly used in lash adjuster assemblies, to include aerated fluid because air causes unreliable operation.

Fluid housings can be filled or refilled with fluid prior to installation, sometimes requiring a complex mechanism or process to access critical fluid chambers within the fluid housings. Known methods for filling or refilling fluid housings can require disassembly of the housings, which is time consuming and can damage components within the housings.

One other method for eliminating air in a fluid housing is disclosed in U.S. Pat. No. 9,650,921. This reference requires mounting a fluid housing in a spinning structure which de-aerates the fluid housing via a centrifuge.

It would be desirable to provide a more convenient and efficient method for filling a fluid housing with fluid.

SUMMARY

A method of filling at least one fluid housing with fluid is disclosed. The method includes: (a) arranging at least one fluid housing within a sealable vessel containing a fluid and attached to a vacuum; and (b) activating the vacuum such that air is withdrawn from the sealable vessel and the fluid is drawn into the at least one fluid housing.

The method can further include (c) deactivating the vacuum and allowing pressure within the sealable vessel to reach atmospheric pressure, and (d) reactivating the vacuum after step (c) to draw more fluid into the at least one fluid housing.

In one embodiment, a pressure within the vessel during step (b) is less than or equal to 1.5 millibar.

In one embodiment, the at least one fluid housing is completely submerged in the fluid during step (a). In another embodiment, the at least one fluid housing is partially submerged in the fluid during step (a).

The at least one fluid housing can include a plurality of fluid housings each arranged within the sealable vessel.

In one embodiment, the activation step of step (b) has a duration of at least 90 seconds.

In one embodiment, the fluid is at least 120 degrees Fahrenheit.

The method can further include applying ultrasonic vibrations to the vessel during step (b).

The at least one fluid housing can be at least one of: (i) a single feed hydraulic lash adjuster; (ii) a dual feed hydraulic lash adjuster; (iii) a switching roller tappet; or (iv) a bucket tappet.

The at least one fluid housing is preferably arranged upright in the sealable vessel. The at least one fluid housing can include a radially extending port, and the radially extending port is submerged in the fluid.

Additional embodiments are disclosed herein.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1A:
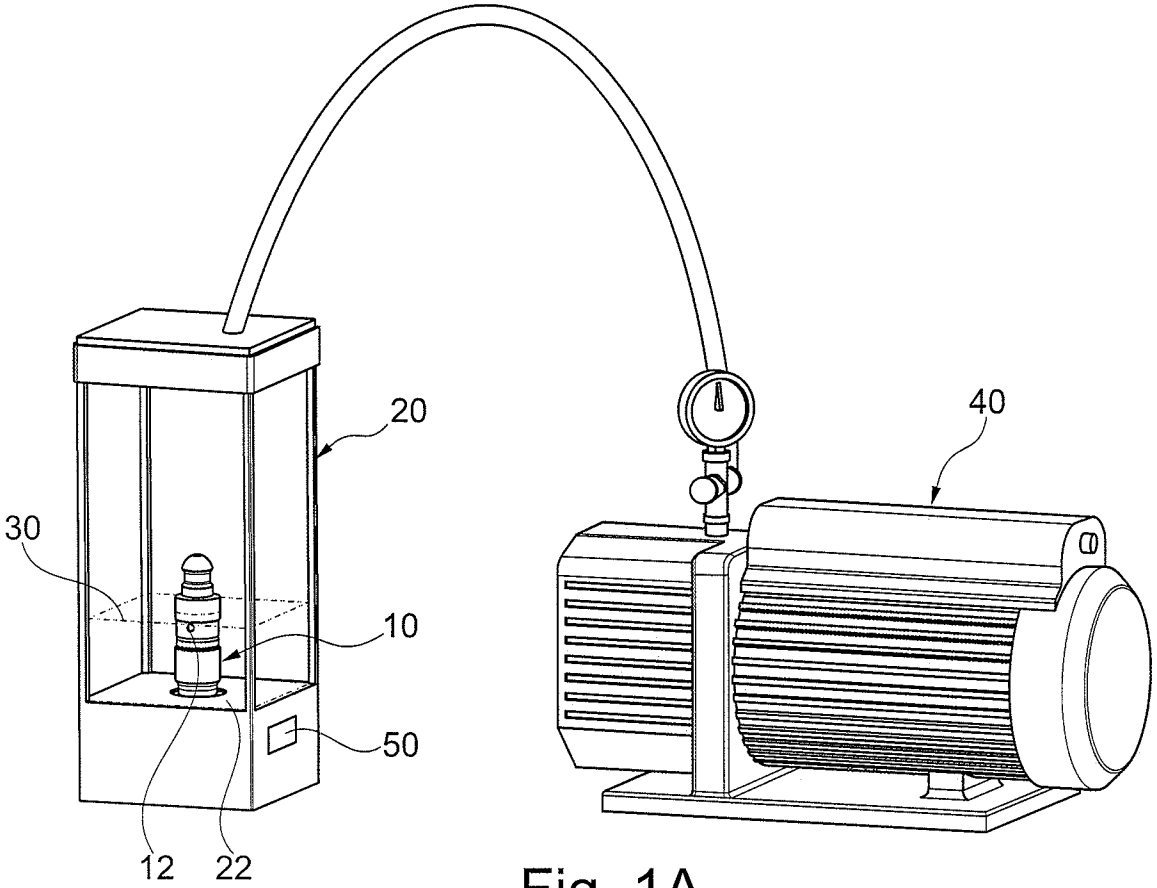
FIG. 1A is perspective view of a filling system for a fluid housing.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

FIG. 1A illustrates a first embodiment for filling an interior chamber of a fluid housing 10. The fluid housing 10 is illustrated inside of a sealable vessel 20, which contains a fluid 30. A vacuum 40 is attached to the sealable vessel 20.

The vacuum 40 can include any known vacuum system, including a power source, pressure monitor, and tubing attached to the sealable vessel 20. The sealable vessel 20 can include a base 22 including attachment regions for holding the fluid housing 10 in place. The base 22 can include a magnet or can be magnetic to hold the fluid housing 10 in place against the base 22.

A method of filling the least one fluid housing 10 is disclosed. The method includes (a) arranging the at least one fluid housing 10 within the sealable vessel 20 containing fluid 30 and attached to the vacuum 40. The method also includes (b) activating the vacuum 40 such that the at least one fluid housing 10 is filled with fluid 30.

In one embodiment, pressure within the vessel 20 during step (b) is less than or equal to 1.5 millibar. One of ordinary skill in the art would recognize that the pressure inside the vessel 20 can be varied.

Figure 2A:
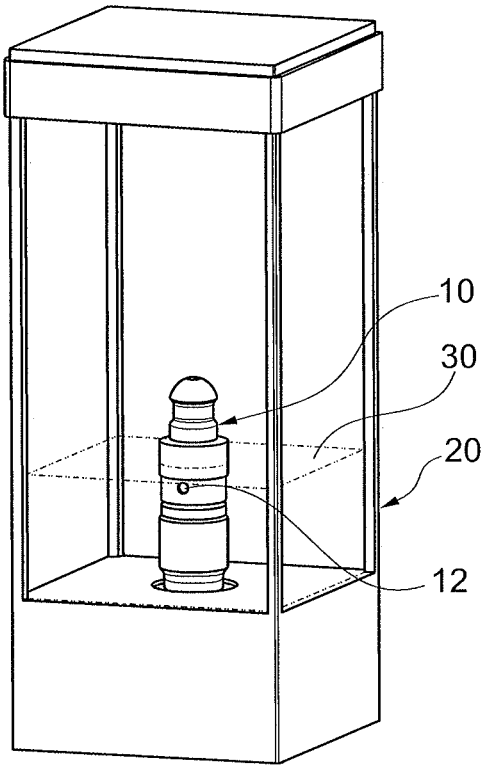
FIGS. 2A and 2B illustrate a fluid housing in a vessel at a first fluid level.
Figure 2B:
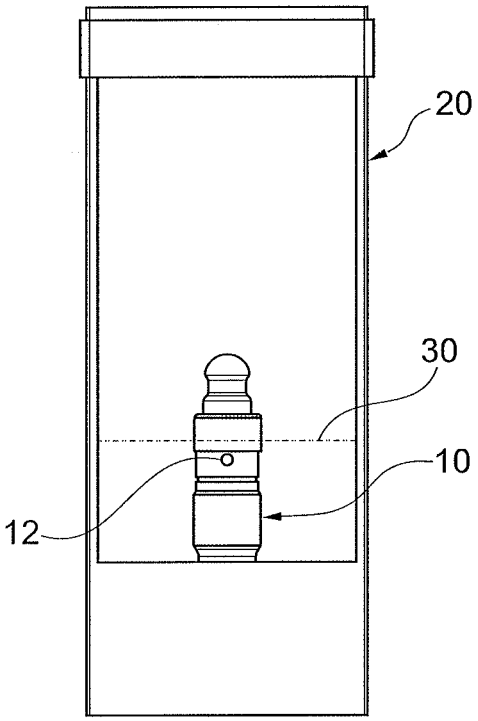
Figure 2C:
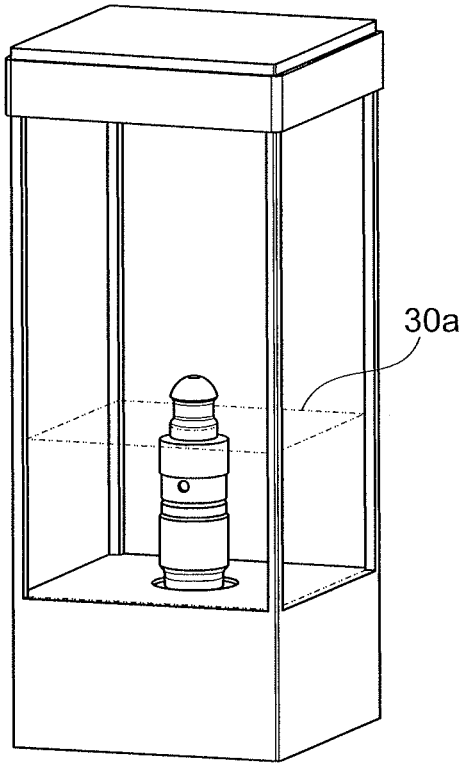
FIGS. 2C and 2D illustrate a fluid housing in a vessel at a second fluid level.
Figure 2D:
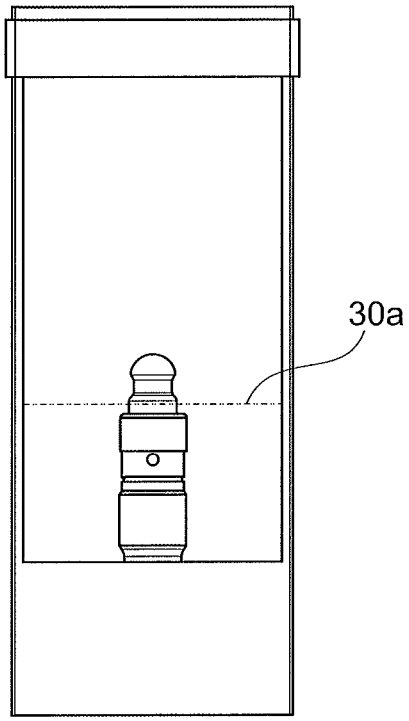
Figure 2E:
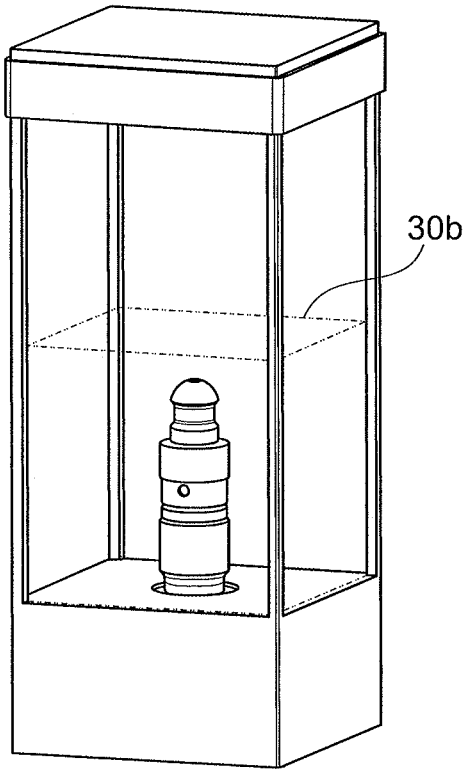
FIGS. 2E and 2F illustrate a fluid housing in a vessel at a third fluid level.
Figure 2F:
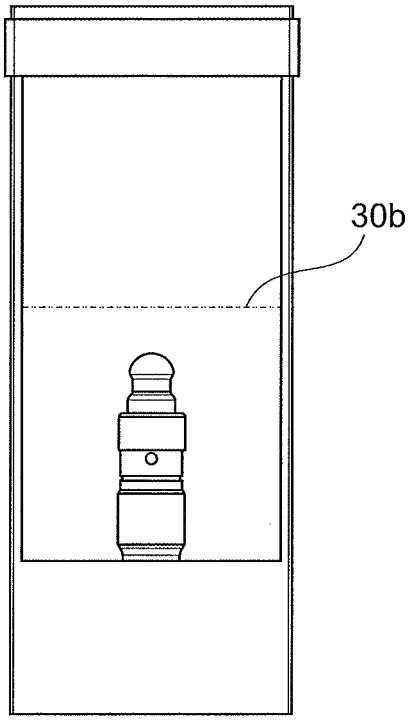
Figure 3A:
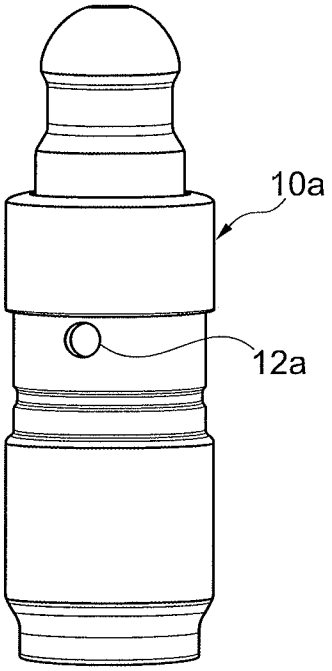
FIG. 3A illustrates a single feed lash adjuster for use in the system shown in FIG. 1A.
Figure 3B:
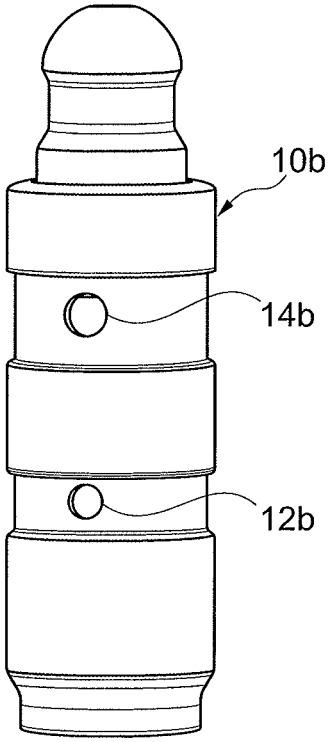
FIG. 3B illustrates a dual feed lash adjuster for use in the system shown in FIG. 1A.
Figure 3C:
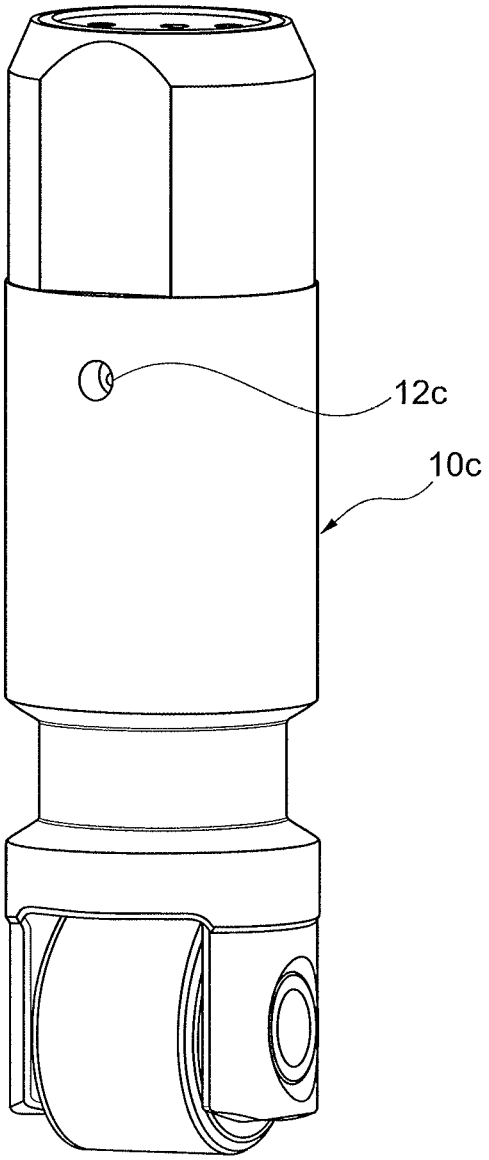
FIG. 3C illustrates a switching roller tappet for use in the system shown in FIG. 1A.
Figure 3D:
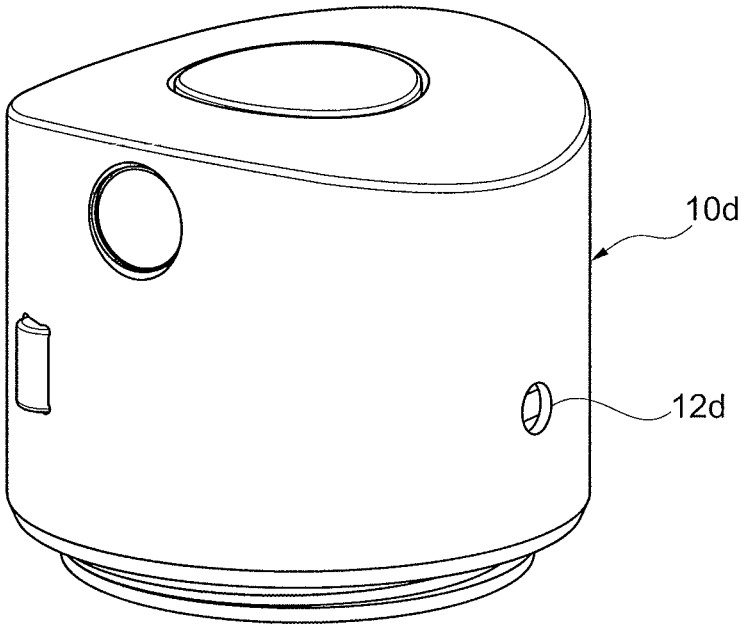
FIG. 3D illustrates a bucket tappet for use in the system shown in FIG. 1A.

In one embodiment, shown in FIGS. 2A-2D, the at least one fluid housing 10 is partially submerged in the fluid 30 during step (a). In one embodiment, shown in FIGS. 2E and 2F, the at least one fluid housing 10 is completely submerged in the fluid 30 during step (a). The fluid level relative to the housing 10 can be varied, particularly depending on the particular arrangement of the housing 10 and its associated port locations.

Figure 1B:
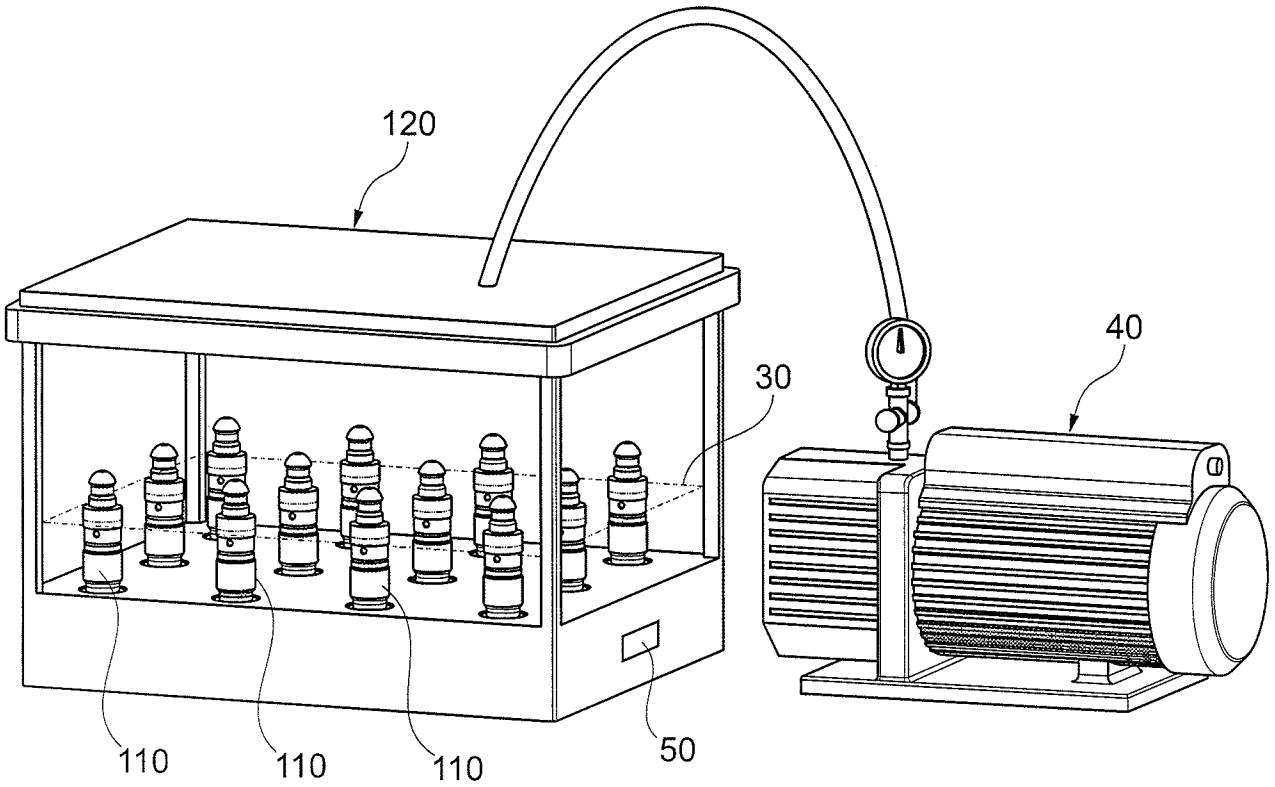
FIG. 1B is a perspective view of a filling system for a plurality of fluid housings.

As shown in FIG. 1B, in one embodiment, the at least one fluid housing 10 includes a plurality of fluid housings 110 that are each arranged within the sealable vessel 120. In this way, multiple housings 110 can be filled at once. The housings 110 are held stationary during the filling process. The amount of housings 110 that can be filled are only limited by the size of the sealable vessel 120.

In one embodiment, the activation step of step (b) has a duration of at least 90 seconds. This duration ensures that a sufficient number of air bubbles have been removed and a sufficient amount of fluid 30 is injected into an interior of the fluid housing 10. The duration of step (b) can be varied.

In one embodiment, the method further includes (c) deactivating the vacuum 40 and allowing pressure within the sealable vessel 20 to reach atmospheric pressure, and then (d) reactivating the vacuum 40 after step (c) to draw more fluid 30 into the at least one fluid housing 10. Steps (c) and (d) can be cyclically carried out to provide multiple rounds of filling of the housing 10. In one embodiment, steps (c) and (d) are each carried out at least two times.

In one embodiment, the fluid 30 is at least 120 degrees Fahrenheit. A relatively higher temperature of the fluid 30 ensures that the fluid 30 has a lower viscosity and more freely flows out of the housing 10. One of ordinary skill in the art would recognize that the temperature of the fluid 30 can be varied.

In one embodiment, the method further includes applying ultrasonic vibrations to the vessel 20 during step (b). As shown in FIG. 1A, an ultrasonic actuator or transducer 50 is attached to the vessel 20. One of ordinary skill in the art would recognize that the ultrasonic actuator or transducer 50 can be in direct contact with the fluid 30. The ultrasonic actuator or transducer 50 applies vibrations to the vessel 20 and/or the fluid 30 such that air bubbles are dislodged from the fluid housing 10. As used herein, the term ultrasonic means vibrations of at least 15,000 cycles per second.

In one embodiment, the at least one fluid housing 10 is arranged upright in the sealable vessel 20. The term upright is defined herein as referring to positioning the housing 10 in an upwardly extending direction relative to its longitudinal axis.

The at least one fluid housing 10 includes at least one radially extending port 12, and the at least one radially extending port 12 is submerged in the fluid 30. The fluid housing 10 can include any number of ports.

The term fluid housing 10 is used generically herein to refer to any housing partially containing a fluid and which is submerged in the vessel 20. For example, the fluid housing 10 is at least one of: (i) a single feed hydraulic lash adjuster 10*a* (shown in FIG. 3A); (ii) a dual feed hydraulic lash adjuster 10*b* (shown in FIG. 3B); (iii) a switching roller tappet 10*c* (shown in FIG. 3C); or (iv) a bucket tappet 10*d* (shown in FIG. 3D). As shown in FIGS. 3A-3D, each of these components 10*a*-10*d* have associated ports or openings 12*a*, 12*b*, 14*b*, 12*c*, and 12*d*. One of ordinary skill in the art would understand that any of the components shown in FIGS. 3A-3D can be inserted in the vessel 20 in FIG. 1A to replace housing 10.

Figure 4:
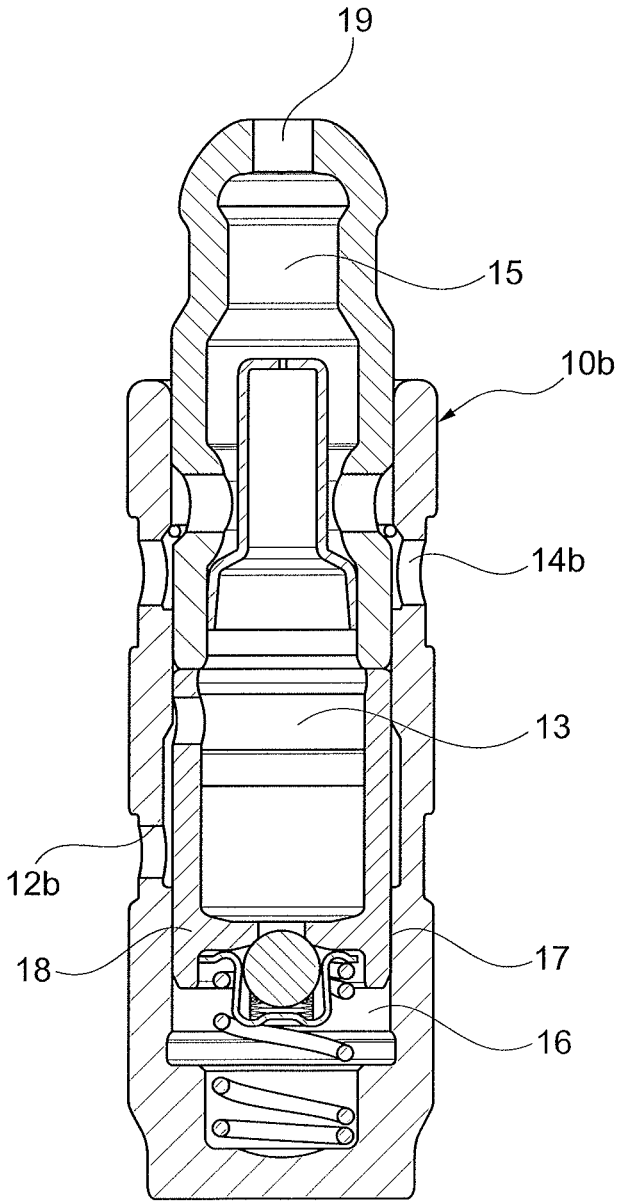
FIG. 4 illustrates a cross section of a dual feed lash adjuster.

As disclosed herein, the method includes filling the interior chambers of a fluid housing 10*b*, as shown in FIG. 4. Three interior chambers 13, 15, 16 are illustrated in FIG. 4. Port 12*b* is connected directly to chambers 13 and 16, and port 14*b* is directly connected to chamber 15. Chamber 13 can be described as a low-pressure reservoir for the hydraulic lash adjustment portion or lower portion of the fluid housing 10*b*. Chamber 16 can be described as a high-pressure chamber for the hydraulic lash adjustment portion of the fluid housing 10*b*. Fluid is drawn into chamber 16 either through chamber 13 or via port 12*b* by way of a leakdown land 17 formed between an outer diameter of a plunger 18 and an inner diameter of the fluid housing 10*b*. Chamber 15 can be described as a switching fluid chamber that can deliver fluid via chamber opening 19 to actuate an adjacent component such as a rocker arm. Based on the methods disclosed herein, these chambers 13, 15, 16 are filled. Similar interior chambers are defined within the other housings illustrated herein, such as inside the single feed hydraulic lash adjuster 10*a* of FIG. 3A, the switching roller tappet 10*c* of FIG. 3C, and the bucket tappet 10*d* of FIG. 3D.

The methods disclosed herein are also effective at deaerating the fluid housings by drawing air bubbles out of the housings and replacing the air with fluid.

The term fluid is used generically herein to refer to any type of fluid, such as hydraulic fluid or oil. In one embodiment, the fluid is more viscous than water.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

LOG OF REFERENCE NUMERALS fluid housing 10
port 12, 14
chambers 13, 15, 16
leakdown land 17
plunger 18
chamber opening 19
sealable vessel 20
base 22
fluid 30
vacuum 40
ultrasonic actuator 50

What is claimed is:

1. A method of filling at least one fluid housing with fluid, the method comprising:

(a) arranging at least one fluid housing within a sealable vessel containing a fluid and attached to a vacuum, the at least one fluid housing being stationary and upright inside the sealable vessel, such that the at least one fluid housing contacts a base of the sealable vessel, the at least one fluid housing including at least one radially extending port such that the at least one radially extending port is submerged in the fluid, and the at least one fluid housing is at least one of: (i) a single feed hydraulic lash adjuster; (ii) a dual feed hydraulic lash adjuster; (iii) a switching roller tappet; or (iv) a bucket tappet; and (b) activating the vacuum such that air is withdrawn from the sealable vessel and the fluid is drawn into the at least one fluid housing.

2. The method of claim 1, wherein a pressure within the sealable vessel during step (b) is less than or equal to 1.5 millibar.

3. The method of claim 1, wherein the at least one fluid housing is completely submerged in the fluid during step (a).

4. The method of claim 1, wherein the at least one fluid housing is partially submerged in the fluid during step (a).

5. The method of claim 1, wherein the at least one fluid housing includes a plurality of fluid housings each arranged within the sealable vessel.

6. The method of claim 1, wherein the vacuum is actuated for at least 90 seconds during step (b).

7. The method of claim 1, wherein the method further comprising:

(c) deactivating the vacuum and allowing pressure within the sealable vessel to reach atmospheric pressure, and (d) reactivating the vacuum after step (c) to draw more fluid into the at least one fluid housing.

8. The method of claim 1, wherein the fluid is at least 120 degrees Fahrenheit.

9. The method of claim 1, further comprising applying ultrasonic vibration to the sealable vessel during step (b).

10. The method of claim 1, further comprising attaching an ultrasonic transducer or actuator to the sealable vessel.

11. The method of claim 1, wherein the fluid housing includes at least one of: (i) a high-pressure chamber; (ii) a low-pressure reservoir; or (iii) a switching fluid chamber.

12. A method of filling at least one fluid housing, the method comprising:

(a) arranging at least one fluid housing including a radially extending port within a sealable vessel containing a fluid, such that the radially extending port is submerged in the fluid, the at least one fluid housing being stationary and upright inside the sealable vessel, such that the at least one fluid housing contacts a base of the sealable vessel, the at least one fluid housing is at least one of: (i) a single feed hydraulic lash adjuster; (ii) a dual feed hydraulic lash adjuster; (iii) a switching roller tappet; or (iv) a bucket tappet, and attaching the sealable vessel to a vacuum; and (b) activating the vacuum such that air is withdrawn from an interior of the at least one fluid housing and the fluid is drawn into the at least one fluid housing.

13. The method of claim 12, wherein the fluid is at least 120 degrees Fahrenheit.

14. The method of claim 12, wherein further comprising applying ultrasonic vibrations to the sealable vessel during step (b).

15. The method of claim 12, wherein the vacuum is actuated for at least 90 seconds during step (b).

16. The method of claim 12, further comprising applying ultrasonic vibrations to the sealable vessel during step (b).

17. The method of claim 12, further comprising:

(c) deactivating the vacuum and allowing pressure within the sealable vessel to reach atmospheric pressure, and (d) reactivating the vacuum after step (c) to draw more fluid into the at least one fluid housing.

18. The method of claim 1, wherein the base of the sealable vessel is magnetic and configured to hold the at least one fluid housing upright and stationary.

* * * * *